US005474182A

United States Patent [19]

Reney

[11] Patent Number: 5,474,182

[45] Date of Patent: Dec. 12, 1995

[54] REVOLVING INDEX CASE FOR SETS OF DRILLS AND THE LIKE

[76] Inventor: Anthony S. Reney, 127 Shuttle Meadow Ave., New Britain, Conn. 06052

[21] Appl. No.: 260,264

[22] Filed: Jun. 14, 1994

[51] Int. Cl.[6] ..... B65D 85/20

[52] U.S. Cl. ..... 206/379; 206/443

[58] Field of Search ..... 206/379, 443; 312/73, 97.1, 234, 295

[56] References Cited

U.S. PATENT DOCUMENTS

| | | | |
|---|---|---|---|
| 702,904 | 6/1902 | Abraham | 206/379 |
| 992,336 | 5/1911 | Burrows | 206/379 |
| 2,315,815 | 6/1944 | Jensen | 206/379 |
| 2,513,894 | 7/1950 | Rogers | 206/379 |
| 2,919,796 | 1/1960 | Pressl | 206/379 |
| 3,072,244 | 1/1963 | Smith | 206/379 |
| 3,319,780 | 5/1967 | Russell | 206/379 |
| 3,615,004 | 10/1971 | Wescott | 206/379 |
| 4,222,486 | 9/1990 | Roth et al. | 206/379 |

FOREIGN PATENT DOCUMENTS

| | | | |
|---|---|---|---|
| 934935 | 1/1948 | France | 206/379 |
| 71228 | 12/1944 | Norway | 206/379 |

OTHER PUBLICATIONS

"Plastic Drill Cases," Modern Packaging, p. 115, Jul. 1947.

*Primary Examiner*—Jimmy G. Foster

[57] ABSTRACT

Disclosed is an index case for sets of drills and the like for storing, organizing, transporting, and displaying sets of elongated objects which permits selection of one of the set while simultaneously positively retaining unselected objects within the case. The index case comprises a body having a plurality of spaced apart elongated chambers aligned along several patterns of concentrically spaced rings, each ring of chambers defining a group. A rotatable cover plate has several angularly spaced apart apertures therethrough and rotatable selector plate has several angularly aligned apertures therethrough, each aperture being aligned with a group. The cover and selector are cooperable with the case body such that rotating the selector selects a specific group whereas rotating the selector and the cover together selects a specific chamber within the group for permitting objects to be inserted and extracted, all other chambers being blocked by the combined solid portions of the selector and cover plates.

6 Claims, 4 Drawing Sheets

REVOLVING INDEX CASE FOR SETS OF DRILLS AND THE LIKE

BACKGROUND OF THE INVENTION

1. Field of the Invention

The present invention relates to cases for drills and the like and more particularly pertains to a revolving index case for sets of drills and the like which may be adapted for storing, organizing, transporting, and displaying sets of elongated objects within a compact case which permits selection of one of the set while simultaneously positively retaining unselected objects within the case.

2. Description of the Prior Art

The use of cases for drills and the like is known in the prior art. More specifically, cases for drills and the like heretofore devised and utilized for the purpose of storing twist drills and similar elongated objects are known to consist basically of familiar, expected and obvious structural configurations, notwithstanding the myriad of designs encompassed by the crowded prior art which have been developed for the fulfillment of countless objectives and requirements.

The present invention is directed to improving devices for storing twist drills and similar elongated objects in a manner which is safe, secure, economical and aesthetically pleasing.

The prior art discloses a multi-carrier drill bit container as shown in U.S. Pat. No. 5,071,005 to Hemmings et al., a drill bit carrying case in U.S. Pat. No. 4,598,822 to Hemmings, a drill bit index case of U.S. Pat. No. 4,512,467 to Knoblauch, a protective carrying case for drill bits in U.S. Pat. No. 4,244,469 to Miner, and a drill holding case of U.S. Pat. No. 3,870,149 to Huot.

While these devices fulfill their respective, particular objectives and requirements, the aforementioned patents do not disclose a revolving index case for sets of drills and the like for storing, organizing, transporting, and displaying sets of elongated objects within a compact case which permits selection of one of the set while simultaneously positively retaining unselected objects within the case.

In this respect, the revolving index case for sets of drills and the like according to the present invention substantially departs from the conventional concepts and designs of the prior art, and in so doing provides an apparatus primarily developed for the purpose of storing, organizing, transporting, and displaying sets of elongated objects.

Therefore, it can be appreciated that there exists a continuing need for a revolving index case for sets of drills and the like which can be used for storing, organizing, transporting, and displaying sets of elongated objects within a compact case which permits selection of one of the set while simultaneously positively retaining unselected objects within the case. In this regard, the present invention substantially fulfills this need.

As illustrated by the background art, efforts are continuously being made in an attempt to develop devices for storing twist drills and similar elongated objects. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of cases for drills and the like now present in the prior art, the present invention provides a new case construction wherein the same can be utilized for storing, organizing, transporting, and displaying sets of elongated objects which permits selection of one of the set while simultaneously positively retaining unselected objects within the case. As such, the general purpose of the present invention, which will be described subsequently in greater detail, is to provide a revolving index case apparatus and method which has all the advantages of the prior art cases for drills and the like and none of the disadvantages.

The invention is defined by the appended claims with the specific embodiment shown in the attached drawings. For the purpose of summarizing the invention, the invention may be incorporated into a revolving index case for sets of drills and the like for storing, organizing, transporting, and displaying sets of elongated objects within a compact case which permits selection of one of the set while simultaneously positively retaining unselected objects within the case.

The revolving index case for sets of drills and the like comprises a generally cylindrical rigid case body formed of transparent solid plastic having first and second squared ends. The case body also has a plurality of longitudinal angularly spaced apart elongated chambers extending thereinto, each chamber having a mouth opening at the first end of the case body. The chambers are aligned relative each other along several patterns of concentrically spaced rings concentrically positioned on the case body whereby each ring of chambers defines a group. The case body also has a central longitudinal threaded bore formed in the first end thereof.

A discoid cover plate formed of transparent solid plastic has a central hole therethrough. The cover is in spaced facing rotating relationship with the first end of the case body such that the central hole of the cover aligns with the central longitudinal bore of the case body. The cover also has several angularly spaced apart apertures therethrough, each aperture being radially aligned with a separate chamber group.

The cover is cooperable with the case body such that rotating the cover relative the case body aligns each aperture with a chamber from a corresponding group whereby selecting one chamber from each group for permitting objects to be inserted thereinto and extracted therefrom. All other chambers are blocked by the solid portions of the cover plate. The cover further has an arcuate concentrically positioned aperture formed therethrough proximal the edge thereof.

A discoid selector plate formed of transparent solid plastic has a central hole therethrough. One side of the selector is in touching facing rotating relationship with the first end of the case body and the other side of the selector is in touching facing rotating relationship with the cover. The central hole of the selector aligns with the central longitudinal bore of the case body and also aligns with the central hole of the cover. The selector also has several angularly aligned apertures therethrough, each aperture being radially aligned with a separate chamber group.

The selector is cooperable with the cover and case body such that rotating the selector relative the cover and the case body aligns one of the angularly aligned selector apertures with one of the angularly spaced cover apertures for selecting a specific group of chambers. Rotating the selector and the cover relative the case selects a specific chamber within the group previously selected for permitting objects to be inserted into and extracted from the specific selected chamber. All other chambers are blocked by the combined solid portions of the selector plate and the cover plate.

The selector plate further has a selector knob projecting perpendicularly from the major plane thereof and proximal the edge thereof. The selector knob extends through the arcuate aperture of the cover plate such that the selector plate may be rotated relative the cover plate by sliding the selector knob along the length of the arcuate aperture. The degree of selector plate rotation relative the cover plate is limited by the length of the arcuate aperture.

A bolt extends through the central hole of the cover plate and also extends through the central hole of the selector plate. The bolt is further threadedly engaged with the central longitudinal threaded bore of the case body such that the cover plate, the selector plate, and the case body may be independently rotated relative each other.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a revolving index case for sets of drills and the like for storing, organizing, transporting, and displaying sets of elongated objects.

It is another object of the present invention to provide a revolving index case for sets of drills and the like which may be easily and efficiently manufactured and marketed.

It is a further object of the present invention to provide a revolving index case for sets of drills and the like which is of a durable and reliable construction.

An even further object of the present invention is to provide a revolving index case for sets of drills and the like which is susceptible of a low cost of manufacture with regard to both materials and labor, and which accordingly is then susceptible of low prices of sale to the consuming public, thereby making such revolving index cases for sets of drills and the like economically available to the buying public.

Still yet another object of the present invention is to provide a revolving index case for sets of drills and the like which provides in the apparatuses and methods of the prior art some of the advantages thereof, while simultaneously overcoming some of the disadvantages normally associated therewith.

Still yet another object of the present invention is to provide a revolving index case for sets of drills and the like that is compact.

Yet another object of the present invention is to provide a revolving index case for sets of drills and the like which permits selection of one of the set while simultaneously positively retaining unselected objects within the case regardless of case orientation, even if dropped.

Even still another object of the present invention is to provide a revolving index case for sets of drills and the like that provides a way to quickly remove objects which may get stuck inside.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top perspective view of the preferred embodiment of the present invention revolving index case for sets of drills and the like.

DESCRIPTION OF THE PREFERRED EMBODIMENT

Figure 1:
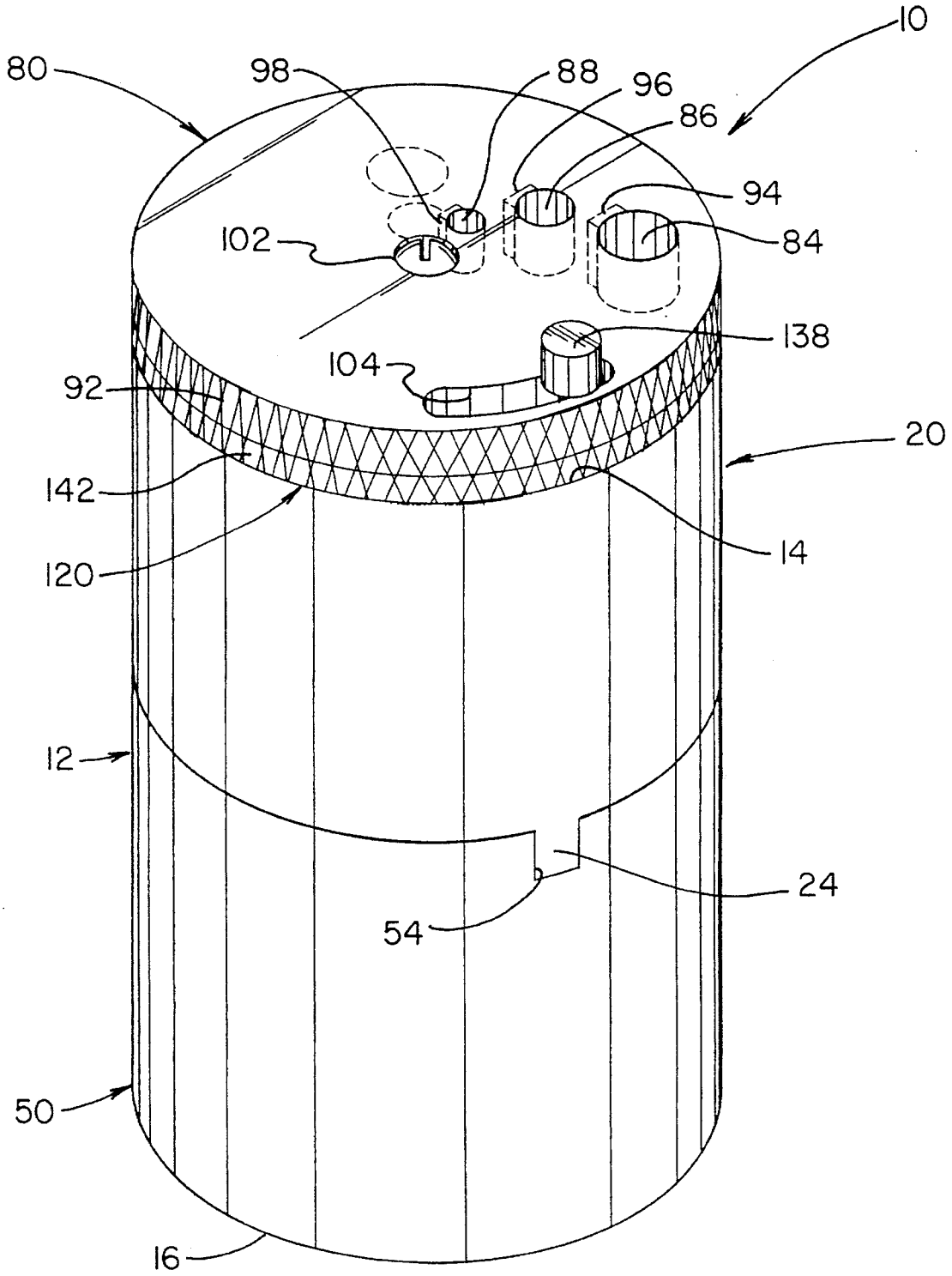
Figure 2:
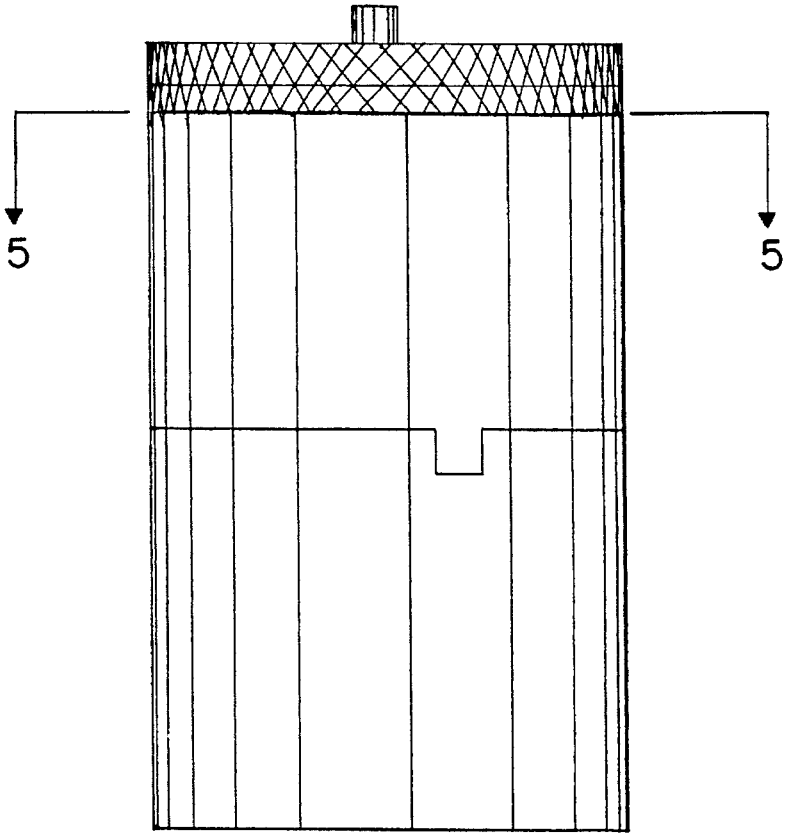
FIG. 2 is a side elevational view of the invention of FIG. 1.
Figure 3:
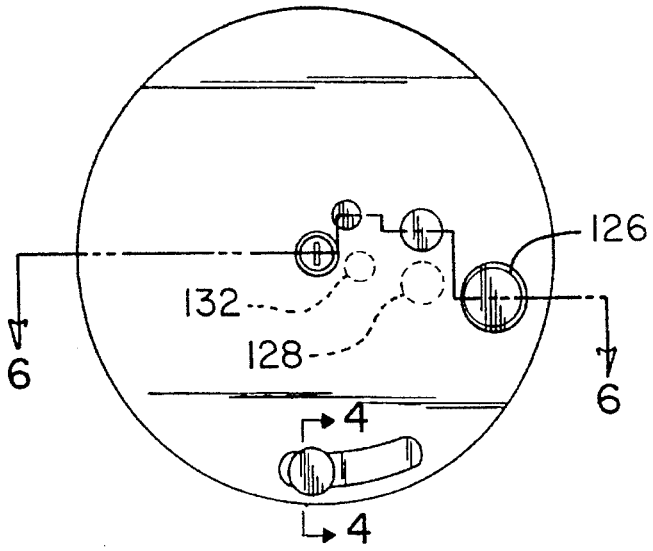
FIG. 3 is a top plan view of the invention of FIG. 1 illustrating the alignment of the radially spaced cover apertures relative to the radially aligned selector apertures.
Figure 4:
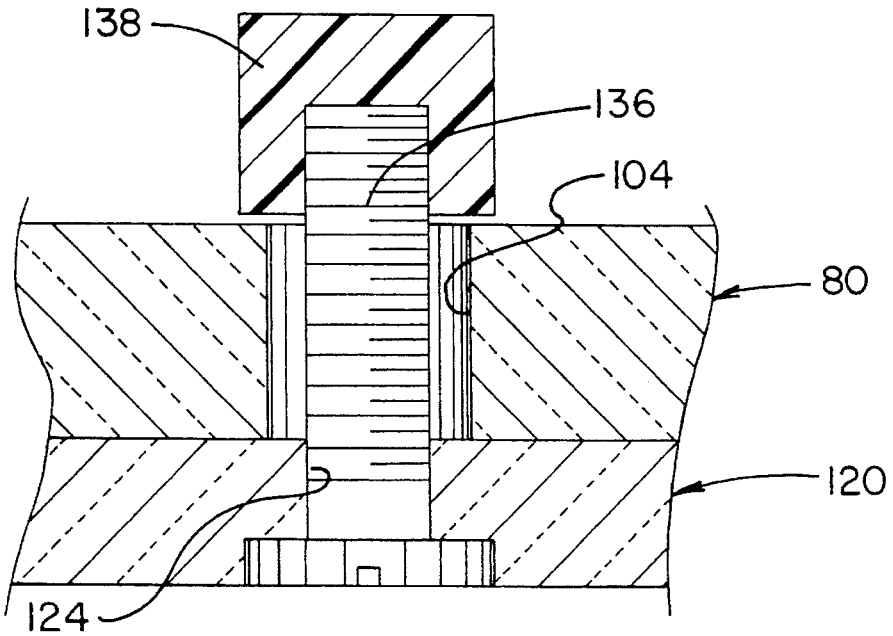
FIG. 4 is a sectional view of the invention of FIG. 3 taken along the line 4—4 and showing the manner of construction of the selector knob.
Figure 5:
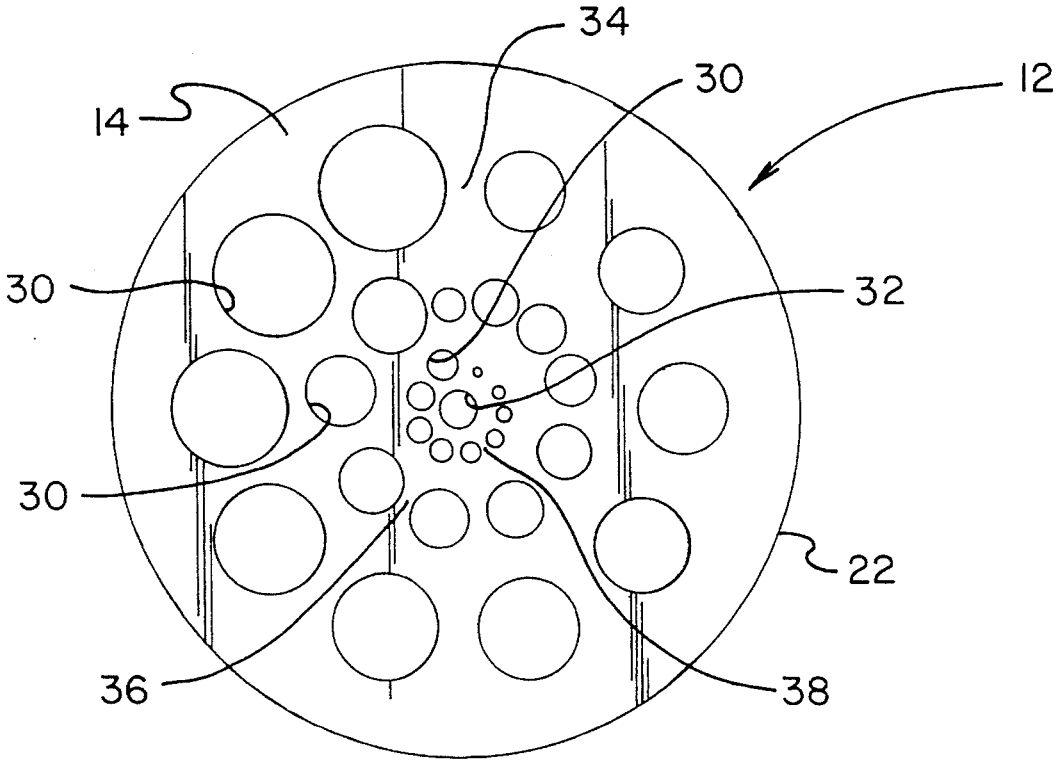
FIG. 5 is a sectional view of the invention of FIG. 2 taken along the line 5—5 depicting the concentrically aligned groups of chambers.
Figure 6:
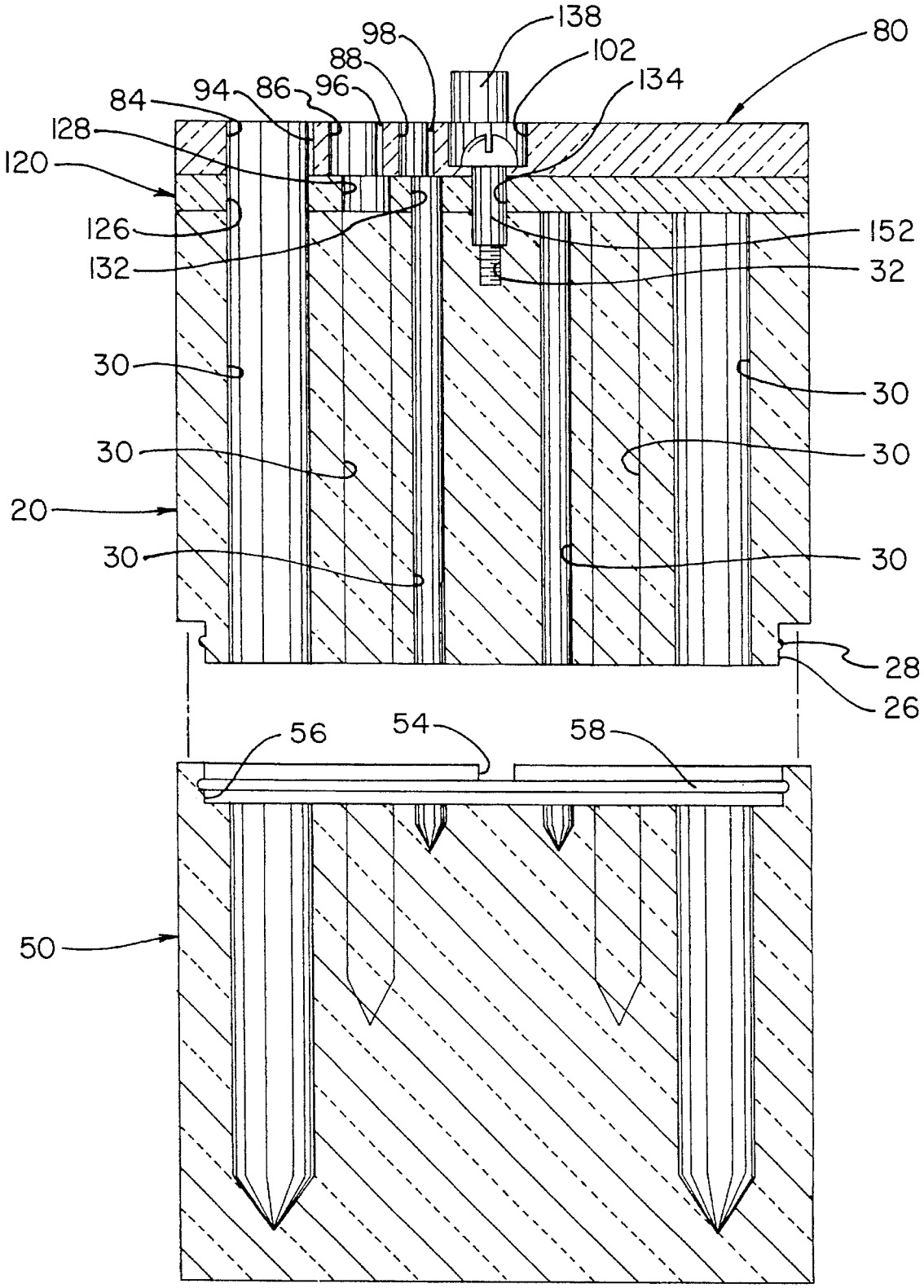
FIG. 6 is a partially exploded sectional view of the invention of FIG. 1 taken along the longitudinal axis and showing the manner of separation of the top and bottom case body sections.

With reference now to the drawings, and in particular to FIG. 1 thereof, a revolving index case for sets of drills and the like embodying the principles and concepts of the present invention and generally designated by the reference numeral 10 will be described.

From an overview standpoint, the revolving index case for sets of drills and the like is adapted for use for storing, organizing, transporting, and displaying sets of elongated objects within a compact case which permits selection of one of the set while simultaneously positively retaining unselected objects within the case. See FIG. 1.

With reference now to FIGS. 1–6 and more specifically, it will be noted that a revolving index case for sets of drills and the like 10 is shown.

The revolving index case for sets of drills and the like 10 comprises a generally cylindrical rigid case body 12 formed of transparent solid plastic having first and second squared ends 14 and 16. The case body 12 also has twenty-nine longitudinal angularly spaced apart elongated chambers 30 extending thereinto, each chamber 30 having a mouth opening at the first end 14 of the case body 12. Each chamber 30 is appropriately sized to receive an object intended to be placed therein. The chambers 30 are aligned relative each other along three patterns of concentrically spaced rings concentrically positioned on the case body 12 whereby each ring of chambers defines a group 34, 36, and 38. The case body 12 also has a central longitudinal threaded bore 32 formed in the first end 14 thereof.

The case body 12 is laterally separable into top and bottom sections 20 and 50 whereby an object stuck inside a chamber 30 may be removed. The plane of separation extends laterally through the case body 12 and also extends through the chambers 30 formed therein to provide an opening in the chambers 30 intermediate the ends thereof when the case sections 20 and 50 are separated. The bottom section 50 has an upwardly opening round socket 56 formed therein, the socket having an interior annular groove 58 formed proximal an edge of the socket opening. The top section 20 has a downwardly projecting socket 56 engagable protrusion 26 formed thereon, the protrusion having an annular ring 28 snapidly engagable with the annular groove 58 of the socket 56 whereby the top and bottom sections 20 and 50 may be removably secured together.

The bottom section 50 also has an alignment notch 54 formed in a socket 56 wall engagable with a tab 24 formed in the top section 20 protrusion 26 whereby angular misalignment of the secured together top and bottom sections is prevented.

A discoid cover plate 80 formed of transparent solid plastic has a central counterbored hole 102 therethrough. The edge 92 of the cover plate 80 is knurled to provide an improved gripping surface thereon. The cover 80 is in spaced facing rotating relationship with the first end 14 of the case body such that the central hole 102 of the cover aligns with the central longitudinal bore 32 of the case body. The cover 80 also has three angularly spaced apart apertures 84, 86, and 88 therethrough, each aperture being radially aligned with corresponding chamber groups 34, 36, and 38 respectively.

The cover 80 is cooperable with the case body 12 such that rotating the cover 80 relative the case body 12 aligns each aperture 84, 86, and 88 with a chamber 30 from a corresponding group 34, 36, and 38 whereby selecting one chamber from each group for permitting objects to be inserted thereinto and extracted therefrom. All other chambers are blocked by the solid portions of the cover plate 80. The cover 80 further has an arcuate concentrically positioned aperture 104 formed therethrough proximal the edge 92 thereof.

The cover plate 80 additionally has a permanent magnet 94, 96, and 98 disposed thereon adjacent each of the angularly spaced apart apertures 84, 86, and 88 for magnetically engaging an object contained within a chamber 30 to prevent the object from dropping entirely through the aperture 84, 86, and 88 when the case 10 is inverted.

A discoid selector plate 120 formed of transparent solid plastic has a central hole 134 therethrough. The edge 142 of the selector plate 120 is knurled to provide an improved gripping surface thereon. One side of the selector 120 is in touching facing rotating relationship with the first end 14 of the case body 12 and the other side of the selector 120 is in touching facing rotating relationship with the cover 80. The central hole 134 of the selector 120 aligns with the central longitudinal bore 32 of the case body 12 and also aligns with the central counterbored hole 102 of the cover 80. The selector 120 also has three angularly aligned apertures 126, 128, and 132 therethrough, each aperture 126,128, and 132 being radially aligned with corresponding chamber groups 34, 36, and 38 respectively.

The selector 120 is cooperable with the cover 80 and case body 12 such that rotating the selector 120 relative the cover 80 and the case body 12 aligns one of the angularly aligned selector apertures 126, 128, and 132 with one of the angularly spaced cover apertures 84, 86, and 88 for selecting a specific group of chambers 34, 36, or 38. Rotating the selector 120 and the cover 80 relative the case body 12 selects a specific chamber 30 within the group 34, 36, or 38 previously selected for permitting objects to be inserted into and extracted from the specific selected chamber. All other chambers are blocked by the combined solid portions of the selector plate 120 and the cover plate 80.

The selector plate 120 further has a counterbored hole 124 therethrough proximal the edge 142, the counterbore being formed in the bottom of the selector plate 120. A pan head machine screw 136 extends upwardly through the counterbored hole 124, the screw head lying inside the counterbore such that the screw head is flush with the bottom surface of the selector plate 120. The screw 136 also extends through the arcuate aperture 104 of the cover plate 80 and is threadedly engaged with a selector knob 138 such that the selector plate 120 may be rotated relative the cover plate 80 by sliding the selector knob 138 along the length of the arcuate aperture 104. The degree of selector plate 120 rotation relative the cover plate 80 is limited by the length of the arcuate aperture 104.

A round head shoulder screw 152 extends through the central counterbored hole 102 of the cover plate 80 and also extends through the central hole 134 of the selector plate 120. The screw 152 is further threadedly engaged with the central longitudinal threaded bore 32 of the case body 12 such that the cover plate 80, the selector plate 120, and the case body 12 may be independently rotated relative each other.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A revolving index case for sets of drills for storing, organizing, transporting, and displaying sets of elongated objects within a compact case which permits selection of one of the set while simultaneously positively retaining unselected objects within the case, the revolving index case for sets of drills comprising:

a generally cylindrical rigid case body formed of transparent solid plastic having first and second squared ends, the case body also having a plurality of longitudinal angularly spaced apart elongated chambers extending thereinto, each chamber having a mouth opening at the first end of the case body, the chambers being aligned relative each other along several patterns of concentrically spaced rings concentrically positioned on the case body whereby each ring of chambers defines a group, the case body also having a central longitudinal threaded bore formed in the first end thereof, the case body being separable into top and bottom sections whereby an object stuck inside a chamber may be removed, the plane of separation extending laterally through the case body and also extending through the chambers formed therein to provide an opening in the chambers intermediate the ends thereof when the case sections are separated, the bottom section having an upwardly open round socket formed therein, the socket having an interior annular groove formed proximal an edge of the socket opening, the top section having a downwardly projecting socket engagable protrusion formed thereon, the protrusion having an annular ring snapidly engagable with the annular groove of the socket whereby the top and bottom sections may be removably secured together, the bottom section also having an alignment notch formed in a socket wall engagable with a tab formed in the top section protrusion whereby angular misalignment of the secured together top and bottom sections is prevented;

a discoid cover plate formed of a transparent plastic having a central hole therethrough, the cover being in spaced facing rotating relationship with the first end of the case body such that the central hole of the cover aligns with the central longitudinal bore of the case body, the cover also having several angularly spaced apart apertures therethrough, each aperture being radially aligned with a separate chamber group, the cover being cooperable with the case body such that rotating the cover relative the case body aligns each aperture with a chamber from a corresponding group whereby selecting one chamber from each group for permitting objects to be inserted thereinto and extracted therefrom, all other chambers being blocked by the solid portions of the cover plate, the cover further having an arcuate concentrically positioned aperture formed therethrough proximal the edge thereof;

a discoid selector plate formed of a transparent solid plastic having a central hole therethrough, one side of the selector being in touching facing rotating relationship with the first end of the case body and the other side of the selector being in touching facing rotating relationship with the cover, the central hole of the selector aligning with the central longitudinal bore of the case body and also aligning with the central hole of the cover, the selector also having several angularly aligned apertures therethrough, each aperture being radially aligned with a separate chamber group, the selector being cooperable with the cover and case body such that rotating the selector relative the cover and the case body aligns one of the angularly aligned selector apertures with one of the angularly spaced cover apertures for selecting a specific group of chambers whereas rotating the selector and the cover relative the case selects a specific chamber within the group previously selected for permitting objects to be inserted into and extracted from the specific selected chamber, all other chambers being blocked by the combination of the solid portions of the selector plate and the cover plate, the selector plate further having a selector knob projecting perpendicularly from the major plane thereof and proximal the edge thereof, the selector knob extending through the arcuate aperture of the cover plate such that the selector plate may be rotated relative the arcuate aperture, the degree of selector plate rotation relative the cover plate being limited by the length of the arcuate aperture; and a bolt extending through the central hole of the cover plate and also extending through the central hole of the selector plate, the bolt further being threadedly engaged with the central longitudinal threaded bore of the case body such that the cover plate, the selector plate, and the case body may be independently rotated relative each other.

2. The revolving index case for sets of drills and the like of claim 1 wherein the edge of the cover plate and the edge of the selector plate are knurled to improve gripping thereof.

3. The revolving index case for sets of drills and the like of claim 2 wherein the cover plate further has a permanent magnet disposed thereon adjacent each of the several angularly spaced apart apertures thereof for preventing an object contained within a chamber from dropping entirely through the aperture when the case is inverted by magnetically engaging the object.

4. A revolving index case for sets of drills for storing, organizing, transporting, and displaying sets of elongated objects within a compact case which permits selection of one of the set while simultaneously positively retaining unselected objects within the case, the revolving index case for sets of drills comprising:

an elongated case body having at least one squared end, the case body also having a plurality of longitudinal angularly spaced apart elongated chambers extending thereinto, each chamber having a mouth opening at the at least squared end of the case body, the chambers being aligned relative each other along several patterns of concentrically spaced rings concentrically positioned on the case body whereby each ring of chambers defines a group, the case body being separable into top and bottom sections whereby an object stuck inside a chamber may be removed, the plane of separation extending laterally through the case body and also extending through the chambers formed therein to provide an opening in the chambers intermediate the ends thereof when the case sections are separated, the bottom section having an upwardly open round socket formed therein, the socket having an interior annular groove formed proximal an edge of the socket opening, the top section having a downwardly projecting socket engagable protrusion formed thereon, the protrusion having an annular ring snapidly engagable with the annular groove of the socket whereby the top and bottom sections may be removably secured together, the bottom section also having an alignment notch formed in a socket wall engagable with a tab formed in the top section protrusion whereby angular misalignment of the secured together top and bottom sections is prevented;

a cover plate in spaced facing rotating relationship with the at least one squared end of the case body, the cover also having several angularly spaced apart apertures therethrough, each aperture being radially aligned with a separate chamber group, the cover being cooperable with the case body such that rotating the cover relative the case body aligns each aperture with a chamber from a corresponding group whereby selecting one chamber from each group for permitting objects to be inserted thereinto and extracted therefrom, all other chambers being blocked by the solid portions of the cover plate;

a selector plate having one side thereof in touching facing rotating relationship with the at least one squared end of the case body and the other side thereof in touching facing rotating relationship with the cover, the selector also having several angularly aligned apertures therethrough, each aperture being radially aligned with a separate chamber group, the selector being cooperable with the cover and case body such that rotating the selector relative the cover and the case body aligns one of the angularly aligned selector apertures with one of the angularly spaced cover apertures for selecting a specific group of chambers whereas rotating the selector and the cover relative the case selects a specific chamber within the group previously selected for permitting objects to be inserted into and extracted from the specific selected chamber, all other chambers being blocked by the combination of the solid portions of the selector plate and the cover plate; and a fastening means for rotatably fastening the cover plate to the selector plate and for rotatably fastening the combined cover plate and the selector plate to the case body.

5. The revolving index case for sets of drills and the like of claim 4 wherein the edge of the cover plate and the edge of the selector plate are knurled to improve gripping thereof.

6. The revolving index case for sets of drills and the like of claim 5 wherein the cover plate further has a permanent magnet disposed thereon adjacent each of the several angularly spaced apart apertures thereof for preventing an object contained within a chamber from dropping entirely through the aperture when the case is inverted by magnetically engaging the object.

* * * * *